US005284449A

United States Patent [19]

Vaccaro

[11] Patent Number: 5,284,449

[45] Date of Patent: Feb. 8, 1994

[54] CONNECTOR FOR A CONDUIT WITH AN ANNULARLY CORRUGATED OUTER CASING

[75] Inventor: Ronald A. Vaccaro, Oxford, Conn.

[73] Assignee: Amphenol Corporation, Wallingford, Conn.

[21] Appl. No.: 60,912

[22] Filed: May 13, 1993

[51] Int. Cl.[5] ..... H01R 13/00

[52] U.S. Cl. ..... 439/583

[58] Field of Search ..... 439/578-585

[56] References Cited

U.S. PATENT DOCUMENTS

| | | | |
|---|---|---|---|
| 3,910,673 | 10/1975 | Stokes | 339/177 R |
| 4,046,451 | 9/1977 | Juds et al. | 439/583 |
| 4,687,272 | 8/1987 | Spinner et al. | 439/271 |
| 4,824,400 | 4/1989 | Spinner | 439/578 |
| 4,824,401 | 4/1989 | Spinner | 439/584 |
| 4,995,832 | 2/1991 | Thommen et al. | 439/578 |
| 5,137,470 | 8/1992 | Doless | 439/583 |
| 5,166,477 | 11/1992 | Perin, Jr. et al. | 439/583 |

*Primary Examiner*—Joseph H. McGlynn
*Attorney, Agent, or Firm*—Bacon & Thomas

[57] ABSTRACT

A connector for a conduit having an annular corrugated outer casing includes a clamping member which fits over an end of the casing, a ring split in one place along its circumference which fits into a corrugation trough, a housing having a conically bevelled clamping surface for engaging an inner surface of the last corrugation of the cable, and cooperating threaded portions on the clamping member and housing. Threading of the housing over the clamping member serves to draw and hold the conically bevelled clamping surface and a clamping surface of the split ring together against opposite surfaces of the outer conductor of the cable.

25 Claims, 2 Drawing Sheets

CONNECTOR FOR A CONDUIT WITH AN ANNULARLY CORRUGATED OUTER CASING

BACKGROUND OF THE INVENTION

1. Field of the Invention

The invention relates to a connector for a conduit which has an annularly corrugated outer casing, and in particular to a connector for a coaxial cable with an annularly corrugated outer conductor.

2. Description of Related Art

The use of coaxial cables for the transmission of intelligence by way of the propagation of electromagnetic energy is well known. The present invention is particularly suited to coaxial cables, and in particular to a type of coaxial cable which has an annularly corrugated outer conductor. This type of cable is used in applications where high mechanical strength and the ability to withstand severe environmental conditions are required. Connectors for such cables must not only meet the strength and durability requirements, but must also have a characteristic impedance which matches that of the cable to permit the highest frequency carried by the cable to be transmitted without significant loss.

A variety of connectors suitable for use with coaxial cables having annularly corrugated outer conductors are known. Examples include those disclosed in U.S. Pat. Nos. 5,996,843 (Thommen et al.) 4,824,400 (Spinner), 4,824,401 (Spinner), 4,687,272 (Spinner et al.), 4,046,451 (Juds et al.), 3,910,673 (Stokes), 3,678,446 (Siebelist), 3,291,895 (Van Dyke), and 3,040,288 (Edlen et al.), as well as in German laid-open patent specification No. 2 221 931 (Spinner et al.) and publication entitled Cable Metal RF Feeder System Catalogue, Edition 3.

The present invention has features in common with many of these connectors, each of which is for a coaxial cable having an annularly corrugated outer conductor. For example, such connectors generally use of some type of wedging arrangement for wedging the outer conductor against the connector housing. While many of the previously known arrangements work fine, however, they are generally relatively expensive to implement. For example, the connector shown in the Juds et al. patent includes a clamping member similar in shape to the clamping member of the invention, but in which the clamping member includes longitudinal slots to create spring fingers integral therewith in order to provide the clamping force necessary to ensure good electrical contact. This concept is mechanically acceptable, but it is expensive to cut the necessary slots in the clamping member, and the method requires a secondary machining operation to create the bevelled clamping surface of the clamping member, which tends to raise burrs. The requirement of a bevelled clamping surface on the clamping member is also a disadvantage of the similar device shown in the Edlen et al. patent.

Other examples of relatively complex arrangements, or arrangements which are difficult to assemble due to the need for special tools, include the use of helically-shaped screwed into corrugations of the conduit, as disclosed in the Thommen et al. patent, an elastic plastic ring disposed within a metal connector casing under a compressive force provided by a fastener (the Spinner '401 patent and the German Spinner publication), or a helical spring in a similar arrangement (the Spinner '400 patent), a corrugated pipe nut and screw cap arrangement (the Spinner et al. patent), and a collet and collet clamp assembly to apply a radial force on the outer conductor of the coaxial cable (the Stokes patent).

SUMMARY OF THE INVENTION

It is accordingly an objective of the invention to provide a connector for a conduit which has an annularly corrugated outer casing, in particular an electrical connector for a coaxial cable having an annularly corrugated outer conductor, which can be installed and removed without the use of any special tools.

It is a further objective of the invention to provide a connector for a conduit which has an annularly corrugated outer casing, in particular an electrical connector for a coaxial cable which has an annularly corrugated outer conductor, which can be efficiently and economically manufactured.

These objectives are achieved in a preferred embodiment of the invention by a connector assembly which includes an externally threaded clamping member fitted over an end of the cable and a split ring disposed in a corrugation trough adjacent the end of the outer conductor. The clamping member includes a transverse end surface which, when an internally threaded housing is threaded onto the clamping member, pushes the split ring against a conically beveled clamping surface in the housing to thereby clamp the end of the outer conductor between the split ring and the conically bevelled surface.

In an especially advantageous embodiment of the invention, a tapered camming surface is provided to radially compress the ring against the outer conductor as it is pushed against the clamping surface to thereby prevent rotation of the ring around the cable after assembly of the connector.

DETAILED DESCRIPTION OF THE PREFERRED EMBODIMENTS

Figure 1:
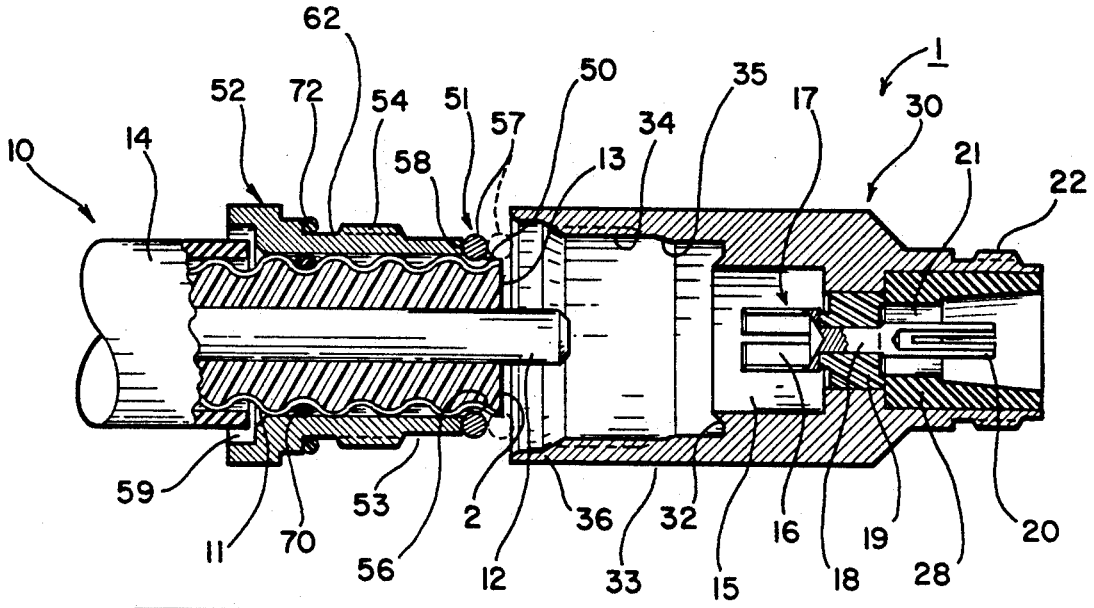
FIG. 1 is a cross-sectional side view of a connector for a conduit which has an annularly corrugated outer casing according to a preferred embodiment of the invention, before coupling of the conduit to the connector.

FIG. 1 shows a connector 1 for a conduit in the form of a coaxial cable 10. The coaxial cable 10 includes a casing in the form of an annularly corrugated outer conductor 11 concentrically spaced from a solid inner conductor 12 by a foam dielectric 13.

The cable is prepared for attachment of the connector assembly by cutting the ends of the cable along a plane extending through the apex of one of the crests of the corrugated outer conductor 11 and perpendicularly to the principal longitudinal axis of the cable. After cutting, a clean and partially flared internal surface of conductor 11 must be exposed adjacent to the cut end of the conductor at the apex of the crest through which the cut is made. The foam dielectric normally does not completely fill the crest of the conductor, simplifying the cable preparation, although FIG. 1 shows the crests as being completely filled. Any burrs or rough edges on the cut end of the metal conductor are also preferably removed at this time to avoid interference with the connector. If the outer surface of the outer conductor 11 is covered with a plastic jacket 14, as illustrated, the plastic jacket is trimmed away from the end of the outer conductor along a sufficient length to permit insertion of the bored outer conductor 11 into the connector assembly.

Figure 2:
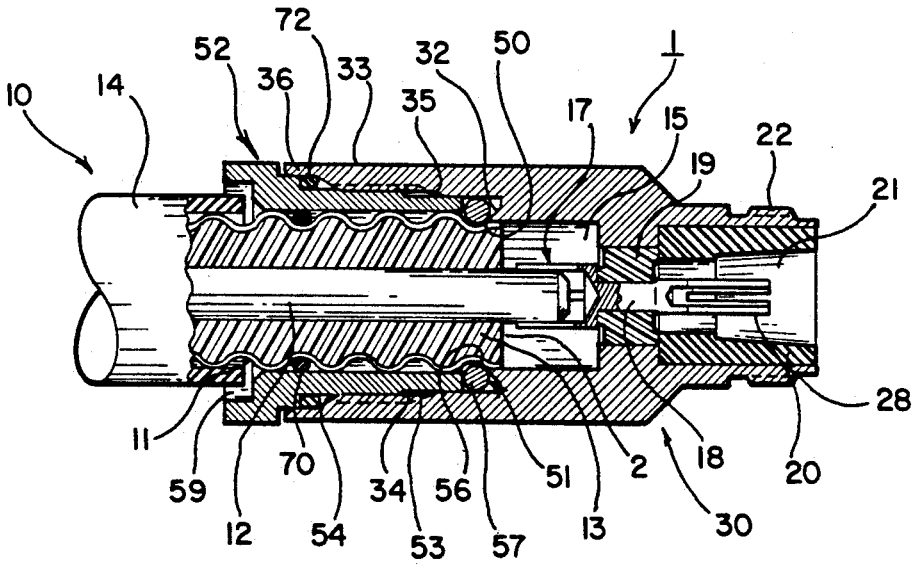
FIG. 2 is a cross-sectional side view of the connector shown in FIG. 1, after coupling of the conduit to the connector.
Figure 3:
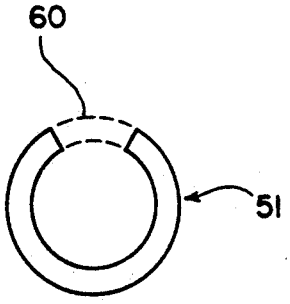
FIG. 3 is an elevated end view of a split ring for use in the connector of FIGS. 1 and 2.
Figure 4:
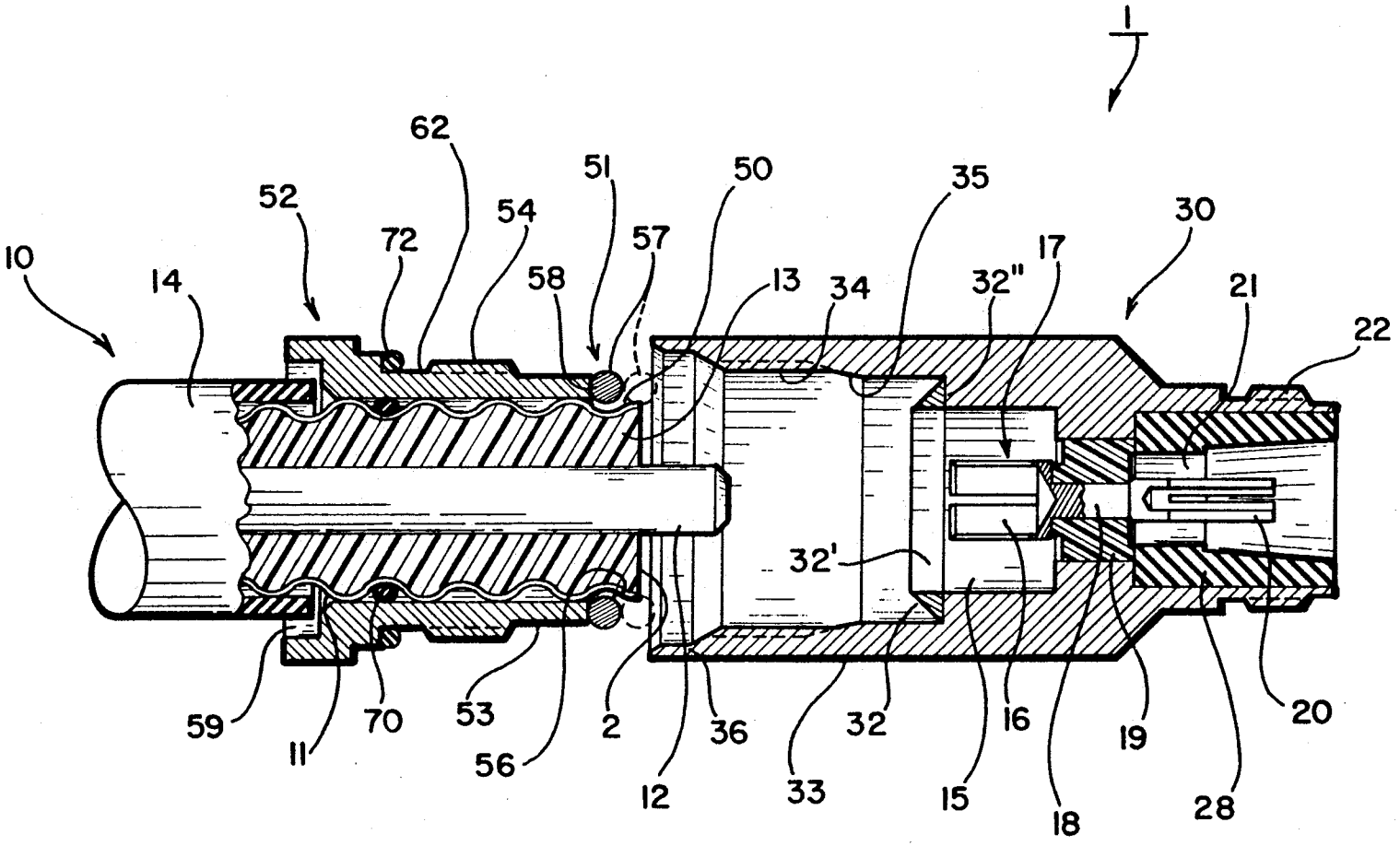
FIG. 4 is a cross-sectional side view of a connector for a conduit which has an annularly corrugated outer casing according to a second preferred embodiment of the invention.

The body member 30 may be made of a rigid conductive material, for example brass, and includes a conically beveled clamping surface 32 which engages the inner surface of the outer conductor 11. Clamping surface 32 may be formed as an integral part of the interior surface of the body member 30, as shown in FIGS. 1 and 2, or it may be formed as a discrete or separate part 32', as shown in FIG. 4, the interior surface of body member 30 including a shelf 32'' for positioning separate part 32'. In either case, surface 32 is continuous around the entire circumference of the cable to ensure good electrical contact between the housing and the inner surface of outer conductor 11. To ensure a good electrical contact with the flared end of the cable, as will be described below, the shape of surface 32 is such that the surface forms a section of a cone which is linear at the intersection between the surface and any plane which includes a longitudinal axis of the connector, the surface forming an obtuse angle in the direction of insertion of the cable 10 into housing 30.

Adjoining clamping surface 32 on one side is a ramp or tapered camming surface 33 (described below) and on the other side is a cylindrical chamber 15 approximately equal in diameter to a diameter of the foam dielectric 13 at the flared end of the cable. Within chamber 15 is an inner conductor-engaging portion 16 of an inner contact 17. A reduced diameter center portion 18 of the conductor 17 is supported and insulated from the housing by an annular dielectric member 19. Inner contact 17 is formed from a resilient conductive material such as phosphor bronze, as is well known, and terminates in a mating portion 20 situated within another chamber 21 of the housing. A bushing 28 surrounds chamber 21 for receiving a mating connector (not shown). The exterior of housing 30 includes a threaded portion 22 for coupling to the mating connector. Both ends 16 and 20 of the contact may be formed with resilient tines in conventional manner.

Cooperating with the clamping surface 32 is a second clamping surface 50 on the exterior of a split ring 51 positioned in the last valley or trough of the corrugated outer conductor 11 adjacent the end of cable 10 so as to lock the ring 51 and the clamping member 52 to the cable in the axial direction of the cable. Spring 51 is made of a resilient conductive material such as, by way of example, phosphor bronze, and is generally in the shape of a toroid, such that clamping surface 50 is curved. Split ring 51 is split in one place along its circumference 60 to form a letter C. This split gives the ring a resilience which allows the ring to be displaced in the outward direction, as suggested by the dashed line in FIG. 1, so as to permit inside surface 56 of the ring 51 to pass over the crest of the corrugated outer conductor as the ring 51 is advanced longitudinally over the end of the cable. The ring 51 then snaps into the last corrugation valley, thereby locking the clamping member 52 to the cable 10 in the axial direction.

A clamping member 52 having a sleeve portion 53 and provided with an externally threaded surface 54 is fitted over the portion of the corrugated outer conductor from which jacket 14, if present, has been removed. Clamping member 52 is made of a rigid conductive material such as brass and optionally includes an enlarged inner and outer diameter portion 59 for accommodating an end of jacket 14. Split-ring 51, when seated in the last valley of the corrugated outer conductor 11 as described above, abuts an end or pressing surface 58 of sleeve 53. Housing 30 also includes a sleeve 33, the interior surface of which is provided with an internally threaded surface 34 mutually engageable with threaded surface 54 of the clamping member 52 to releasably secure the clamping member within the housing and cause pressing surface 58 to push ring 51 into the housing towards clamping surface 32. Sleeve 33 also includes an enlarged diameter portion 36 adjacent threaded surface 34 to permit entry of externally threaded portion 54 of clamping member 52 and provide a sealing surface for o-ring 72.

Threaded portions 34 and 54 of, respectively, the housing 30 and clamping member 52, therefore cooperate to permit housing 30 to be threaded onto clamping member 52, while at the same time advancing split ring 51 towards clamping surface 32, with the flared end of outer conductor 11 sandwiched therebetween. This is preferably accomplished by rotating the housing while keeping the clamping member stationary so as not to twist the cable. When the two members 30 and 52 are rotated relative to each other in a first direction, they are advanced toward each other in the axial direction such that pressing surface 58 of the clamping member 52 pushes on split ring 51 so as to draw the clamping surfaces 32 and 50 into electrically conductive engagement with the outer conductor 11. At the same time, a portion of inner conductor 12, from which dielectric foam 13 has been completely removed, and which may be beveled to facilitate mating, is brought into engagement with portion 16 of inner contact 17. When the annular flared end portion of outer conductor 11 is clamped between surfaces 32 and 50, it is also flattened to conform with the linear cross-section of clamping surface 32, thus ensuring an electrical connection between the corrugated outer conductor 11 and housing 30. To detach the connector assembly from the outer conductor 11, the two members 30 and 52 are simply rotated in an opposite direction from the direction described above to retract the tube members from each other until the threaded surfaces 34 and 54 disengage, by which time the electrical connection will have been released.

In order to avoid rotation of the ring 51 relative to the cable 10 after the connector has been assembled, the housing 30 has a tapered section 35, as briefly noted above, which engages the outer portion 57 of the ring 51 and forces the ring 51 in an inward direction as the ring is pushed by clamping member 52 into the connector to clamp the flared end of the cable against the beveled conical clamping surface 32.

In order to seal the connector against contamination by moisture, corrosive fluids, dust, and the like, O-ring seals may be provided by seating one O-ring 70 of suitable dimensions in any valley or trough between the inside of the clamping member 52 and the outside of the corrugated outer conductor, and by positioning another O-ring 72 of suitable dimensions on diameter 62 of the exterior of clamping member 52 to engage the interior surface of the enlarged portion 36 of sleeve 33, which preferably includes tapered surface 38 for capturing the second O-ring 72, thereby completely sealing the interior of the connector from environmental contamination.

It will of course be appreciated by those skilled in the art that none of the specific materials such as brass or phosphor bronze, as disclosed above, is to be taken as limiting, and that numerous other variations of the invention are possible within its intended scope. For example, the cable to which the connector is attached need not be coaxial, or necessarily even electrical, but may for example form a wave guide structure. Furthermore, it will be appreciated that details of the inner contact structure and mating connector coupling portion form no part of the present invention, which is concerned with connection of the outer corrugated conductor, and thus that the structure of the inner contact and the mating connector coupling portion may be freely varied as desired. Accordingly, it is intended that the above-description and drawings be used solely by way of example or illustration, and that the invention be defined solely by the appended claims.

I claim:

1. A connector assembly for a conduit having an annularly corrugated outer casing, comprising:

a clamping member which includes a pressing surface;

a housing having a bevelled clamping surface positioned to engage an end of a last corrugation of said conduit;

a split ring positioned adjacent the last corrugation; and means on said housing and said clamping member for releasably securing said housing to said clamping member, wherein when the clamping member is secured to the housing by said releasably securing means, the pressing surface presses said split ring against said last corrugation, whereupon the last corrugation is caused to engage the bevelled clamping surface, and the last corrugation is thereby clamped between the split ring and the bevelled clamping surface.

2. A connector assembly as claimed in claim 1, wherein said releasably securing means comprises threaded surfaces on said housing and said clamping member.

3. A connector assembly as claimed in claim 1, wherein said threaded surface on said clamping member is on an exterior surface of said clamping member, and wherein said threaded surface on said housing is on an interior surface of said housing.

4. A connector assembly as claimed in claim 1, wherein said split ring is fitted in the last trough on an exterior of the casing, the last corrugation being a peak.

5. A connector assembly as claimed in claim 1, wherein the bevelled surface forms an obtuse angle with the longitudinal axis of the connector assembly in the direction of insertion.

6. A connector assembly as claimed in claim 1, wherein said beveled surface forms a section of a cone.

7. A connector assembly as claimed in claim 1, wherein said clamping member is fitted over one end portion of the casing which includes said last corrugation.

8. A connector assembly as claimed in claim 1, wherein said beveled clamping surface engages an inside surface of said last corrugation.

9. A connector assembly as claimed in claim 1, wherein said housing further includes a tapered camming surface positioned so as to cause said split ring to radially compress as said ring is pressed into the connector housing in order to prevent rotation of the ring around the conduit.

10. A connector assembly as claimed in claim 1, wherein said bevelled clamping surface is a surface of a discrete part formed separately from the interior surface of the housing, and wherein said surface is continuous around an entire circumference of the conduit.

11. A connector assembly as claimed in claim 1, wherein said conduit is a coaxial cable and said casing is an annularly corrugated outer conductor concentrically spaced from a solid inner conductor by a dielectric, and wherein said housing is made of a conductive material.

12. A connector assembly as claimed in claim 11, wherein said bevelled clamping surface is formed as an integral part of an interior surface of the housing and is continuous around an entire circumference of the cable to ensure electrical contact between the housing and the outer conductor.

13. A connector assembly as claimed in claim 11, wherein said housing further includes an inner contact which engages said inner conductor when said outer conductor is clamped between said clamping surface and said split ring.

14. A connector assembly as claimed in claim 11, wherein said releasably securing means comprises threaded surfaces on said housing and said clamping member.

15. A connector assembly as claimed in claim 11, wherein said threaded surface on said clamping member is on an exterior surface of said clamping member, and wherein said threaded surface on said housing is on an interior surface of said housing.

16. A connector assembly as claimed in claim 11, wherein said split ring is fitted in the last trough on an exterior of the outer conductor, the last corrugation being a peak.

17. A connector assembly as claimed in claim 11, wherein the bevelled surface forms an obtuse angle with the longitudinal axis of the connector assembly in the direction of insertion.

18. A connector assembly as claimed in claim 11, wherein said beveled surface forms a section of a cone.

19. A connector assembly as claimed in claim 11, wherein said clamping member is fitted over one end portion of the outer conductor which includes said last corrugation.

20. A connector assembly as claimed in claim 11, wherein said beveled clamping surface engages an inside surface of said last corrugation.

21. A connector assembly as claimed in claim 11, wherein said housing further includes a tapered camming surface positioned so as to cause said split ring to radially compress as said ring is pressed into the housing in order to prevent rotation of the ring around the cable.

22. A connector assembly as claimed in claim 11, wherein said bevelled clamping surface is a surface of a discrete part formed separately from the interior surface of the housing, and wherein said surface is continuous around an entire circumference of the cable to ensure electrical contact between the housing and the outer conductor.

23. A connector assembly as claimed in claim 22, wherein said interior surface of said housing includes a shelf for positioning said discrete part.

24. A connector assembly as claimed in claim 22, wherein said releasably securing means comprises threaded surfaces on said housing and said clamping member.

25. A connector assembly as claimed in claim 22, wherein said threaded surface on said clamping member is on an exterior surface of said clamping member, and wherein said threaded surface on said housing is on an interior surface of said housing.

* * * * *